US008012918B2

(12) United States Patent
Bertram et al.

(10) Patent No.: US 8,012,918 B2
(45) Date of Patent: Sep. 6, 2011

(54) DETERGENT

(75) Inventors: Richard D. Bertram, Witney (GB); Peter J. Dowding, Wantage (GB); Peter D. Watts, Abingdon (GB)

(73) Assignee: Infineum International Limited, Oxfordshire (GB)

( * ) Notice: Subject to any disclaimer, the term of this patent is extended or adjusted under 35 U.S.C. 154(b) by 0 days.

(21) Appl. No.: 12/596,881

(22) PCT Filed: Apr. 10, 2008

(86) PCT No.: PCT/EP2008/002837

§ 371 (c)(1),
(2), (4) Date: Oct. 21, 2009

(87) PCT Pub. No.: WO2008/128656

PCT Pub. Date: Oct. 30, 2008

(65) Prior Publication Data

US 2010/0087347 A1 Apr. 8, 2010

(30) Foreign Application Priority Data

Apr. 24, 2007 (EP) ..... 07106870
Aug. 23, 2007 (EP) ..... 07114878

(51) Int. Cl.
*C10M 159/22* (2006.01)
*C10M 105/48* (2006.01)
*C10M 129/76* (2006.01)

(52) U.S. Cl. ..... 508/460; 508/462; 508/502

(58) Field of Classification Search ..... 508/460, 508/462, 502
See application file for complete search history.

(56) References Cited

U.S. PATENT DOCUMENTS 5,089,158 A * 2/1992 Van Kruchten et al. ..... 508/553
6,262,001 B1 * 7/2001 Le Coent et al. ..... 508/518

FOREIGN PATENT DOCUMENTS

EP 0298572 A 1/1989
EP 1233053 A 8/2002
WO WO 96/26995 A1 9/1996

* cited by examiner

*Primary Examiner* — Walter Griffin
*Assistant Examiner* — Francis C Campanell

(57) ABSTRACT

An overbased metal hydrocarbyl-substituted hydroxybenzoate detergent having a basicity index of less than 2 and a degree of carbonation of 80% or greater is disclosed. The overbased metal hydrocarbyl-substituted hydroxybenzoate detergent reduces asphaltene precipitation or 'black paint' in a marine diesel engine.

11 Claims, No Drawings

DETERGENT

FIELD OF THE INVENTION

This invention relates to a detergent, in particular, an overbased metal hydrocarbyl-substituted hydroxybenzoate, preferably a hydrocarbyl-substituted salicylate detergent. This invention also relates to a method of reducing asphaltene precipitation which can result in the formation of 'black paint' in an engine, in particular, a marine diesel engine.

BACKGROUND OF THE INVENTION

In marine trunk piston engines, Heavy Fuel Oil ('HFO') is generally used for offshore running. Heavy Fuel Oil is the heaviest fraction of petroleum distillate and comprises a complex mixture of molecules including up to 15% of asphaltenes, which are defined as the fraction of petroleum distillate which is insoluble in an excess of aliphatic hydrocarbon (e.g. heptane) but which shows solubility in aromatic solvents (e.g. toluene). Asphaltenes can enter the engine lubricant as contaminants either via the cylinder or the fuel pumps and injectors, and asphaltene precipitation can then occur, manifested in 'black paint' or 'black sludge' in the engine. The presence of such carbonaceous deposits on a piston surface can act as an insulating layer, which can result in cracks forming, which then propagate through the piston. If a crack travels right the way through, then hot combustion gases can enter the crankcase, which may result in a crankcase explosion.

A key design feature of trunk piston engine oils ('TPEO's) is prevention of asphaltene precipitation but, with the current use of Group II base oils, their effectiveness in this respect has been reduced.

WO 96/26995 discloses the use of a hydrocarbyl-substituted phenol to reduce 'black paint' in a diesel engine. WO 96/26996 discloses the use of a demulsifier for water-in-oil emulsions, for example, a polyoxyalkylene polyol, to reduce 'black paint° in diesel engines.

The aim of the present invention is to reduce asphaltene precipitation or 'black paint' in an engine, in particular, a marine diesel engine. The aim of the present invention is also to reduce asphaltene precipitation or 'black paint' in an engine using a lubricating oil composition comprising a Group II basestock.

SUMMARY OF THE INVENTION

In accordance with the present invention, there is provided an overbased metal hydrocarbyl-substituted hydroxybenzoate detergent having a basicity index of less than 2 and a degree of carbonation of 80% or greater, wherein the degree of carbonation is the percentage of carbonate present in the overbased metal hydrocarbyl-substituted hydroxybenzoate detergent expressed as a mole percentage relative to the total excess base in the detergent.

By 'basicity index' we mean the molar ratio of total base to total soap in the overbased detergent.

The overbased metal hydrocarbyl-substituted hydroxybenzoate detergent preferably has a degree of carbonation of 85% or greater, preferably at least 86%, more preferably at least 87%, even more preferably at least 90%, even more preferably at least 91% and most preferably at least 92%. The degree of carbonation is preferably at most 100%, and more preferably at most 99%.

In accordance with the present invention, there is also provided a lubricating oil composition including an oil of lubricating viscosity and an overbased metal hydrocarbyl-substituted hydroxybenzoate detergent having a basicity index of less than 2 and a degree of carbonation of 80% or greater, wherein the degree of carbonation is the percentage of carbonate present in the overbased metal hydrocarbyl-substituted hydroxybenzoate detergent expressed as a mole percentage relative to the total excess base in the detergent. The oil of lubricating viscosity is preferably a Group II base stock.

The lubricating oil composition is preferably a trunk piston engine oil ('TPEO').

In accordance with the present invention, there is also provided a method of reducing asphaltene precipitation or 'black paint' in an engine, the method including the step of lubricating the engine with a lubricating oil composition including an oil of lubricating viscosity and an overbased metal hydrocarbyl-substituted hydroxybenzoate detergent having a basicity index of less than 2 and a degree of carbonation of 80% or greater, wherein the degree of carbonation is the percentage of carbonate present in the overbased metal hydrocarbyl-substituted hydroxybenzoate detergent expressed as a mole percentage relative to the total excess base in the detergent. The oil of lubricating viscosity is preferably a Group II base stock.

Furthermore, in accordance with the present invention there is provided use in a lubricating oil composition to reduce asphaltene precipitation or 'black paint' in an is engine of an overbased metal hydrocarbyl-substituted hydroxybenzoate detergent having a basicity index of less than 2 and a degree of carbonation of 80% or greater, wherein the degree of carbonation is the percentage of carbonate present in the overbased metal hydrocarbyl-substituted hydroxybenzoate detergent expressed as a mole percentage relative to the total excess base in the detergent.

The engine is preferably a marine diesel engine.

The overbased metal hydrocarbyl-substituted hydroxybenzoate detergent is preferably an overbased calcium hydrocarbyl-substituted hydroxybenzoate detergent. The overbased metal hydrocarbyl-substituted hydroxybenzoate detergent is preferably an overbased metal salicylate detergent, preferably an overbased calcium salicylate detergent.

DETAILED DESCRIPTION OF THE INVENTION

Detergents

A detergent is an additive that reduces formation of piston deposits, for example high-temperature varnish and lacquer deposits, in engines; it normally has acid-neutralising properties and is capable of keeping finely divided solids in suspension. Most detergents are based on metal "soaps"; that is metal salts of acidic organic compounds, sometimes referred to as surfactants.

Detergents generally comprise a polar head with a long hydrophobic tail, the polar head comprising a metal salt of an acidic organic compound. Large amounts of a metal base can be included by reacting an excess of a metal base, such as an oxide or hydroxide, with an acidic gas such as carbon dioxide to give an overbased detergent which comprises neutralised detergent as the outer layer of a metal base (e.g. carbonate) micelle.

The surfactant of the present invention is a hydrocarbyl-substituted hydroxybenzoic acid, preferably a hydrocarbyl-substituted salicylic acid. Hydrocarbyl includes alkyl or alkenyl. The overbased metal hydrocarbyl-substituted hydroxybenzoate typically has the structure shown:

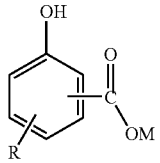

wherein R is a linear or branched aliphatic group, preferably a hydrocarbyl group, and more preferably an alkyl group, including straight- or branched-chain alkyl groups. There may be more than one R group attached to the benzene ring. M is an alkali (e.g. lithium, sodium or potassium) or alkaline earth metal (e.g. calcium, magnesium barium or strontium). Calcium or magnesium is preferred; calcium is especially preferred. The COOM group can be in the ortho, meta or para position with respect to the hydroxyl group; the ortho position is preferred. The R group can be in the ortho, meta or para position with respect to the hydroxyl group.

Hydroxybenzoic acids are typically prepared by the carboxylation, by the Kolbe-Schmitt process, of phenoxides, and in that case, will generally be obtained (normally in a diluent) in admixture with uncarboxylated phenol. Hydroxybenzoic acids may be non-sulphurized or sulphurized, and may be chemically modified and/or contain additional substituents. Processes for sulphurizing a hydrocarbyl-substituted hydroxybenzoic acid are well known to those skilled in the art, and are described, for example, in US 2007/0027057.

In hydrocarbyl-substituted hydroxybenzoic acids, the hydrocarbyl group is preferably alkyl (including straight- or branched-chain alkyl groups), and the alkyl groups advantageously contain 5 to 100, preferably 9 to 30, especially 14 to 24, to carbon atoms.

The term "overbased" is generally used to describe metal detergents in which the ratio of the number of equivalents of the metal moiety to the number of equivalents of the acid moiety is greater than one. The term low-based' is used to is describe metal detergents in which the equivalent ratio of metal moiety to acid moiety is greater than 1, and up to about 2. The metal hydroxybenzoate of the present invention is low-based.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole %, of the cations in the oil-insoluble metal salt, are calcium ions. Cations other than calcium may be derived, for example, from the use in the manufacture of the overbased detergent of a surfactant salt in which the cation is a metal other than calcium. Preferably, the metal salt of the surfactant is also calcium.

Carbonated overbased metal detergents typically comprise amorphous nanoparticles. Additionally, there are disclosures of nanoparticulate materials comprising carbonate in the crystalline calcite and vaterite forms.

The basicity of the detergents is preferably expressed as a total base number (TBN). A total base number is the amount of acid needed to neutralize all of the basicity of the overbased material. The TBN may be measured using ASTM standard D2896 or an equivalent procedure. The detergent may have a low TBN (i.e. a TBN of less than 50), a medium TBN (i.e. a TBN of 50 to 150) or a high TBN (i.e. a TBN of greater than 150, such as 150-500). Preferred detergents according to the invention have a TBN of up to 150.

Overbased metal hydrocarbyl-substituted hydroxybenzoates can be prepared by any of the techniques employed in the art. A general method is as follows:

1. Neutralisation of hydrocarbyl-substituted hydroxybenzoic acid with molar excess of metallic base to produce a slightly overbased metal hydrocarbyl-substituted hydroxybenzoate complex, in a solvent mixture consisting of a volatile hydrocarbon, an alcohol and water;
2. Carbonation to produce colloidally dispersed metal carbonate followed by post-reaction period;
3. Removal of residual solids that are not colloidally dispersed; and
4. Stripping to remove process solvents.

Overbased metal hydrocarbyl-substituted hydroxybenzoates can be made by either a batch or a continuous overbasing process.

Metal base (e.g. metal hydroxide, metal oxide, metal alkoxide and the like), preferably time (calcium hydroxide), may be charged in one or more stages. The charges may be equal or may differ, as may the carbon dioxide charges which follow them. When adding a further calcium hydroxide charge, the carbon dioxide treatment of the previous stage need not be complete. As carbonation proceeds, dissolved hydroxide is converted into colloidal carbonate particles dispersed in the mixture of volatile hydrocarbon solvent and non-volatile hydrocarbon oil.

Carbonation may by effected in one or more stages, over a range of temperatures up to the reflux temperature of the alcohol promoters. Addition temperatures may be similar, or different, or may vary during each addition stage. Phases in which temperatures are raised, and optionally then reduced may precede further carbonation steps.

The volatile hydrocarbon solvent of the reaction mixture is preferably a normally liquid aromatic hydrocarbon having a boiling point not greater than about 150° C. Aromatic hydrocarbons have been found to offer certain benefits, e.g. improved filtration rates, and examples of suitable solvents are toluene, xylene, and ethyl benzene.

The alkanol is preferably methanol although other alcohols such as ethanol can be used. Correct choice of the ratio of alkanol to hydrocarbon solvents, and the water content of the initial reaction mixture, are important to obtain the desired product.

Oil may be added to the reaction mixture; if so, suitable oils include hydrocarbon oils, particularly those of mineral origin. Oils which have viscosities of 15 to 30 cSt at 38° C. are very suitable.

After the final treatment with carbon dioxide, the reaction mixture is typically heated to an elevated temperature, e.g. above 130° C., to remove volatile materials (water and any remaining alkanol and hydrocarbon solvent). When the synthesis is complete, the raw product is hazy as a result of the presence of suspended sediments. It is clarified by, for example, filtration or centrifugation. These measures may be used before, or at an intermediate point, or after solvent removal.

The products are generally used as an oil solution. If there is insufficient oil present in the reaction mixture to retain an oil solution after removal of the volatiles, further oil should be added. This may occur before, or at an intermediate point, or after solvent removal.

Additional materials may form an integral part of the overbased metal detergent. These may, for example, include long chain aliphatic mono- or di-carboxylic acids. Suitable carboxylic acids included stearic and oleic acids, and polyisobutylene (PIB) succinic acids.

Degree of Carbonation ('DOC')

Achieving the desired degree of carbonation ('DOC') level requires practical experience to determine the necessary excess of carbon dioxide. In these circumstances, analytical determinations are essential to determine degree of carbonation ('DOC') levels.

Degree of Carbonation ('DOC') Determination

Metal Carbonate Content by Carbon Dioxide Liberation

Alkali and alkaline earth metal carbonates quantitatively liberate carbon dioxide upon treatment with many strong acids. Absorption of liberated carbon dioxide by a suitable reagent, followed by titration, allows calculation of the detergent's metal is carbonate content. One suitable approach boils a detergent sample (0.2-5.0 g) with excess (e.g. 2 molar) hydrochloric acid. The liberated carbon dioxide is absorbed in a mixture of monoethanolamine in dimethylformamide (1 to 40 parts by volume) and simultaneously titrated with standard (e.g. 0.1 molar) alcoholic tetrabutylammonium hydroxide solution, using thymol blue (3 to 1 parts monoethanolamine, grams per liter) as the indicator. Optionally, interference from hydrogen sulfide is prevented by absorption in a tube containing a suitable reagent, e.g., silver orthovanadate. Care should be taken to exclude atmospheric carbon dioxide from the titrant, by use of guard tubes containing commercial carbon dioxide absorbent (e.g. 20 mesh). To ensure the absorbent mixture is free of carbon dioxide, it is neutralised prior to each reaction/titration using the standard alcoholic tetrabutylammonium hydroxide solution, until the persistent blue colour of the (thymol blue) indicator appears. Good circulation of the absorbent mixture is advisable to ensure complete absorption of the liberated carbon dioxide. A nitrogen flow aids transfer of liberated carbon dioxide from reaction vessel into the absorbent mixture. The titration itself is continued until the persistent blue colour of the indicator appears. A blank determination is advisable.

Calculation:

$$\text{Liberated Carbon Dioxide} = \frac{[(TBAH\ vol.\ (\text{ml})) \times (TBAH\ conc^{n}.\ (\text{moles}/1)) \times 10^{3})]}{\text{mass of detergent sample (g)}}$$

($TBAH$ = tetrabutylammonium hydroxide)

Then:

Metal as carbonate (mmoles/kg)=Liberated carbon dioxide (mmoles/kg)

A similar procedure is described in 'Rapid Method of Determining Carbonates in Sulphonate Additives' by A. F. Lyashenko, V. I. Borisova and A. U. Mazurenko in Trudy-Vsesoyuznyi Nauchno-Issledovatel'skii Institut po Pererabotke Nefti (1976), 14, 217-20.

Metal Hydroxide Content by Strong Base Number

One analytical method to determine strong (or "direct") base number involves titration to phenolphthalein neutral point of a sample dissolved in isopropanol/toluene; with added water/sugar solution (e.g. as described in U.S. Pat. No. 5,259,966, and also cited thereafter in US 20060183650A1, U.S. Pat. No. 6,310,009, U.S. Pat. No. 6,268,318 & U.S. Pat. No. 6,015,778). Strong bases include calcium oxide, calcium hydroxide and also various calcium alkoxides. In processing, calcium hydroxide reacts with sulphonic acid and phenols to form calcium sulphonate and calcium phenate respectively. Neither the calcium sulphonate nor the calcium phenate give a strong base number measurement, i.e., these salts do not titrate to phenolphthalein indicator. Calcium hydroxide also reacts with carbon dioxide to create colloidal calcium carbonate. This also does not give a strong base number measurement. The strong base number in the products of this invention relates to unconsumed calcium hydroxide.

$$\text{Metal as Strong Base (mmoles/kg)} = \frac{SBN \times 10^{2}}{\text{Metal Valency} \times \text{Mol. Wt. } KOH}$$

Degree of Carbonation ('DOC') Calculation

Using the above determinations, DOC can be calculated as follows:

$$DOC\ (\text{moles }\%) = \frac{(\text{Metal as Carbonate})}{[(\text{Metal as Carbonate}) + (\text{Metal as Strong Base})]} \times 10^{2}$$

The lubricating oil composition may include at least one other additive selected from friction modifiers, antiwear agents, dispersants, oxidation inhibitors, viscosity modifiers, pour point depressants, rust inhibitors, corrosion inhibitors, demulsifying components and foam control agents.

Friction Modifiers

Friction modifiers include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted monoamines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. As an example of such oil-soluble organo-molybdenum compounds, there may be mentioned the dithiocarbamates, dithiophosphates, dithiophosphinates, xanthates, thioxanthates, sulphides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

The molybdenum compounds may be of the formula $Mo(ROCS_2)_4$ and $Mo(RSCS_2)_4$ wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of

1 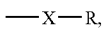

2 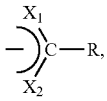

3 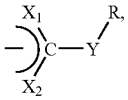

4 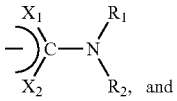

5 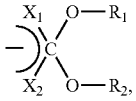

and mixtures thereof, wherein X, $X_1$, $X_2$, and Y are independently selected from the group of oxygen and sulphur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same to hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulphoxy, etc.).
3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between 1 to 100, preferably from 1 to 30, and more preferably between 4 to 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds requires selection of ligands having the appropriate charge to balance the core's charge.

Compounds having the formula $Mo_3S_kL_nQ_z$ have cationic cores surrounded by anionic ligands and are represented by structures such as

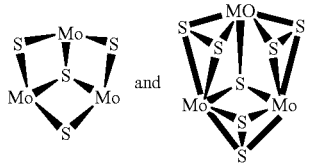

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. This includes the case of a multidentate ligand having multiple connections to a single core. It is believed that oxygen and/or selenium may be substituted for sulphur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulphide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulphide, dialkyldithiocarbamate, or dialkyldithiophosphate, and a sulphur abstracting agent such cyanide ions, sulphite ions, or substituted phosphines. Alternatively, a trinuclear molybdenum-sulphur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. At least 21 total carbon atoms should be present among all the ligand's organo groups. Preferably, the ligand source chosen has a sufficient number of carbon atoms in its organo groups to render the compound soluble or dispersible in the lubricating composition.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The molybdenum compound is preferably an organo-molybdenum compound. Moreover, the molybdenum compound is preferably selected from the group consisting of a molybdenum dithiocarbamate (MoDTC), molybdenum dithiophosphate, molybdenum dithiophosphinate, molybdenum xanthate, molybdenum thioxanthate, molybdenum sulphide and mixtures thereof. Most preferably, the molybdenum compound is present as molybdenum dithiocarbamate. The molybdenum compound may also be a trinuclear molybdenum compound.

Dihydrocarbyl Dithiophosphate Metal Salts

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oils in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

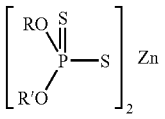

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be 5 or greater. The zinc dihydrocarbyl dithiophosphate can therefore comprise zinc dialkyl dithiophosphates. The present invention may be particularly useful when used with lubricant compositions containing phosphorus levels of from 0.02 to 0.12 wt. %, preferably from 0.03 to 0.10 wt. %. More preferably, the phosphorus level of the lubricating oil composition will be less than 0.08 wt. %, such as from 0.05 to 0.08 wt. %.

Ashless Dispersants

Ashless dispersants maintain in suspension oil insolubles resulting from oxidation of the oil during wear or combustion. They are particularly advantageous for preventing the precipitation of sludge and the formation of varnish, particularly in gasoline engines. Ashless dispersants comprise an oil soluble polymeric hydrocarbon backbone bearing one or more functional groups that are capable of associating with particles to be dispersed. Typically, the polymer backbone is functionalized by amine, alcohol, amide, or ester polar moieties, often via a bridging group. The ashless dispersant may be, for example, selected from oil soluble salts, esters, aminoesters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone of these dispersants is typically derived from an olefin polymer or polyene, especially polymers comprising a major molar amount (i.e., greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, for example, 1 to 10 mole %, is a non-conjugated diene, such as a $C_3$ to $C_{22}$ non-conjugated diolefin (for example, a copolymer of isobutylene and butadiene, or a copolymer of ethylene, propylene and 1,4-hexadiene or 5-ethylidene-2-norbornene). Preferred are polyisobutenyl (Mn 400-2500, preferably 950-2200) succinimide dispersants. Preferably, heavy duty diesel (HDD) engine lubricating oil compositions of the present invention contain an amount of a nitrogen-containing dispersant introducing from 0.08 to 0.25 mass %, preferably from 0.09 to 0.18 mass %, more preferably from 0.10 to 0.15 mass %, of nitrogen into the composition.

Oxidation Inhibitors

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, alkylphenol sulphides, oil soluble phenates and sulphurized phenates, phosphosulphurized or sulphurized hydrocarbons or esters, phosphorous esters, metal thiocarbamates, oil soluble copper compounds as described in U.S. Pat. No. 4,867,890, and molybdenum-containing compounds.

Phosphorus-free supplemental oxidation inhibitors, other than the previously described hindered phenol antioxidants, suitable for use in the present invention include alkaline earth metal salts of alkylphenolthioesters having preferably $C_5$ to $C_{12}$ alkyl side chains, calcium nonylphenol sulfide, ashless oil soluble phenates and sulfurized phenates and phosphosulfurized or sulfurized hydrocarbons.

Aromatic amines having at least two aromatic groups attached directly to the nitrogen constitute another class of compounds that is frequently used for antioxidancy. They are preferably used in only small amounts, i.e., up to 0.4 wt. %, or more preferably avoided altogether other than such amount as may result as an impurity from another component of the composition.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulphur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil-soluble aromatic amines having at least two aromatic groups attached directly to one amine nitrogen should preferably not exceed 0.4 wt. % active ingredient.

Viscosity Modifiers

Viscosity modifiers (VM) function to impart high and low temperature operability to a lubricating oil. The VM used may have that sole function, or may be multifunctional. Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene. Multifunctional viscosity modifiers that further function as dispersants are also known.

A viscosity index improver dispersant functions both as a viscosity index improver and as a dispersant. Examples of viscosity index improver dispersants include reaction products of amines, for example polyamines, with a hydrocarbyl-substituted mono- or dicarboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated mono-carboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralised with an amine, hydroxyamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine or alcohol.

Pour Point Depressants

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates.

Rust Inhibitors

Rust inhibitors selected from the group consisting of non-ionic polyoxyalkylene polyols and esters thereof, polyoxyalkylene phenols, and anionic alkyl sulfonic acids may be used.

Corrosion Inhibitors

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are preferably present in an amount not exceeding 0.2 mass % active ingredient.

Demulsifying Component

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Foam Control

Foam control can be provided by many compounds including an antifoamant of the polysiloxane type, for example, silicone oil or polydimethyl siloxane.

It may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

It is not unusual to add an additive to a lubricating oil, or additive concentrate, in a diluent, such that only a portion of the added weight represents an active ingredient (A.I.). For example, dispersant may be added together with an equal weight of diluent in which case the "additive" is 50% A.I. dispersant. On the other hand, detergents are conventionally formed in diluent to provide a specified TBN and are oftentimes not referred to on an A.I. basis. As used herein, the term mass percent (mass %), when applied to a detergent refers to the total amount of detergent and diluent unless otherwise indicated, and when applied to all other additive refers to the weight of active ingredient unless otherwise indicated.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature. When lubricating compositions contain one or more of the above-mentioned additives, each additive is typically blended into the base oil in an amount that enables the additive to provide its desired function. Representative amounts of such additives, used in crankcase lubricants, are listed below. All the values listed are stated as mass percent active ingredient.

| ADDITIVE | MASS % (Broad) | MASS % (Preferred) |
|---|---|---|
| Ashless Dispersant | 0.1-20 | 1-8 |
| Metal Detergents | 0.1-6 | 0.2-4 |
| Corrosion Inhibitor | 0-5 | 0-1.5 |
| Metal Dihydrocarbyl Dithiophosphate | 0.1-6 | 0.1-4 |

-continued

| ADDITIVE | MASS % (Broad) | MASS % (Preferred) |
|---|---|---|
| Antioxidant | 0-5 | 0.01-1.5 |
| Pour Point Depressant | 0.01-5 | 0.01-1.5 |
| Antifoaming Agent | 0-5 | 0.001-0.15 |
| Supplemental Antiwear Agents | 0-0.5 | 0-0.2 |
| Friction Modifier | 0-5 | 0-1.5 |
| Viscosity Modifier | 0-6 | 0.01-4 |
| Basestock | Balance | Balance |

Preferably, all the additives except for the viscosity modifier and the pour point depressant are blended into a concentrate or additive package described herein as the additive package that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

Crankcase Lubricating Oil Formulation

A crankcase lubricating oil formulation may employ from 2 to 25 mass %, preferably 4 to 20 mass %, and most preferably about 5 to 18 mass % of the concentrate or additive package with the remainder being base stock. Preferably the volatility of the final crankcase lubricating oil formulation, as measured by the Noack volatility test (ASTM D5880), is less than or equal to 15 mass %, preferably less than or equal to 13 mass %, more preferably less than or equal to 12 mass %, most preferably less than or equal to 10 mass %. Preferably, lubricating oil compositions of the present invention have a compositional TBN (using ASTM D4739) of less than about 10.5, such as between 7.5 and 10.5, preferably less than or equal to about 9.5, such as 8.0 to 9.5.

Marine Cylinder Lubricants

A marine cylinder lubricating oil formulation may employ from 10 to 35 mass %, preferably 13 to 30 mass %, and most preferably 16 to 24 mass % of the concentrate or additive package with the remainder being base stock. Preferably, marine cylinder lubricating oil compositions have a compositional TBN (using ASTM D2896) of 40 to 100, such as between 50 and 90.

Trunk Piston Engine Oils

A trunk piston engine oils may employ from 7 to 35 mass %, preferably 10 to 28 mass %, and most preferably 12 to 24 mass % of the concentrate or additive package with the remainder being base stock. Preferably, the trunk piston engine oils have a compositional TBN (using ASTM D2896) of 20 to 60, such as between 25 and 55.

Lubricating Oils

The lubricating oils may range in viscosity from light distillate mineral oils to heavy lubricating oils such as gasoline engine oils, mineral lubricating oils and heavy duty diesel oils. Generally, the viscosity of the oil ranges from 2 $mm^2$/sec (centistokes) to 40 $mm^2$/sec, especially from 4 $mm^2$/sec to 20 $mm^2$/sec, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by is reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additionally processing using techniques for removing spent additives and oil breakdown products.

The oil of lubricating viscosity may comprise a Group I, Group II, Group III, Group IV or Group V base stocks or base oil blends of the aforementioned base stocks. Preferably, the oil of lubricating viscosity is a Group III, Group IV or Group V base is stock, or a mixture thereof provided that the volatility of the oil or oil blend, as measured by the NOACK test (ASTM D5880), is less than or equal to 13.5%, preferably less than or equal to 12%, more preferably less than or equal to 10%, most preferably less than or equal to 8%; and a viscosity index (VI) of at least 120, preferably at least 125, most preferably from 130 to 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.

b) Group II base stocks contain greater than or equal to 90 percent saturates and less than or equal to 0.03 percent sulphur and have a viscosity index greater than or equal to 80 and less than 120 using the test methods specified in Table E-1.

c) Group III base stocks contain greater than or equal to 90 percent saturates and less than or equal to 0.03 percent sulphur and have a viscosity index greater than or equal to 120 using the test methods specified in Table E-1 d) Group IV base stocks are polyalphaolefins (PAO).

e) Group V base stocks include all other base stocks not included in Group II, III, or IV.

The base stock is preferably a Group II base stock.

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

EXAMPLES

The present invention is illustrated by but in no way limited to the following examples. Examples 1-3 are comparative examples and Examples 4-7 are examples of the Invention.

The following overbased metal salicylate detergents were prepared:

| Examples | Basicity Index | Degree of Carbonation, 'DOC' % |
|---|---|---|
| Example 1 | 1.3 | 69 |
| Example 2 | 1.3 | 71 |
| Example 3 | 1.4 | 75 |
| Example 4 | 1.4 | 85 |
| Example 5 | 1.3 | 100 |
| Example 6 | 1.3 | 100 |
| Example 7 | 1.4 | 100 |

Methods for the synthesis of alkylsalicylic acid, and the formation of overbased detergents derived therefrom, are well known to those skilled in the art. For example, such methods are described in US 2007/0027043 and references cited therein. The alkylsalicylic acid used in these Examples was made from C14-C18 linear alpha-olefins, such as those marketed by Shell Chemicals under the name SHOP. It contained approximately 10% moles of unconverted alkylphenol, and had an acid content of 2.62 meq./g.

To obtain low base detergents that were fully carbonated (Examples 5-7), the alkylsalicylic acid was treated with an excess (at least 2 equivalents per equivalent acid) of calcium hydroxide. After neutralisation, surplus lime that was not colloidally stabilised was removed by centrifugation. The reaction mixture was then treated with an excess (at least 2 equivalents per equivalent acid) of carbon dioxide. After carbonation, the product was centrifuged again to remove any further solid material that was not colloidally stabilised.

The overbased metal salicylate detergents were prepared using the following methods.

Charges (g)

| Example | 2 | 3 | 4 | 5 | 6 | 7 |
|---|---|---|---|---|---|---|
| Alkylsalicylic acid | 290 | 290 | 7.04 | 6.00 | 6.00 | 6.00 |
| Xylene | 1321 | 1321 | 196.8 | 190.5 | 190.5 | 190.5 |
| Calcium hydroxide | 37.6 | 37.6 | 0.95 | 3.50 | 1.46 | 1.46 |
| Methanol | 99.7 | 99.7 | 14.9 | 21.2 | 21.2 | 21.2 |
| Distilled water | 3.1 | 3.1 | 0.46 | 0.65 | 0.65 | 0.65 |
| Carbon dioxide | 3.1 | 4.0 | 0.39 | 5.89 | 8.05 | 8.05 |
| Base oil SN150 | 150 | 150 | 4.2 | 4.0 | 3.0 | 3.0 |

Methods

Example 1 is a commercial product, available from Infineum UK Limited under the trade name Infineum M7102.

Example 2

Xylene and alkylsalicylic acid were mixed together in a flask stirred at 600 rpm, and heated to 40° C. in 20 minutes.

Lime was added to the flask, and the mixture was stirred at 600 rpm and 40° C. for 60 minutes.

Methanol and water were added to the flask, and the mixture was stirred at 600 rpm and heated to 55° C. over 40 minutes.

Carbon dioxide was added at a rate of 0.73 litres/minute at 55° C.

The mixture was stirred at 600 rpm and 55° C. for 20 minutes.

The mixture was left at room temperature for five minutes.

The mixture was centrifuged at 1800 rpm for 30 minutes.

After centrifugation the methanol/water formed a cloudy layer on the surface, which was removed using a vacuum pump.

Base oil was added.

Xylene, and any residual methanol and water, were stripped off using a rotary evaporator at 125° C. for two hours.

Example 3

Xylene and alkylsalicylic acid were mixed together in a flask stirred at 600 rpm, and heated to 60° C. in 20 minutes.

Lime was added to the flask, and the mixture was stirred at 600 rpm and 60° C. for 60 minutes.

Methanol and water were added to the flask, and the mixture was stirred at 600 rpm and 60° C. for 40 minutes.

Carbon dioxide was added at a rate of 0.73 liters/minute at 55° C.

The mixture was stirred at 600 rpm and 55° C. for 20 minutes.

The mixture was left at room temperature for five minutes.

The mixture was centrifuged at 1800 rpm for 30 minutes.

After centrifugation the methanol/water formed a cloudy layer on the surface, which was removed using a vacuum pump.

Base oil was added.

Xylene, and any residual methanol and water, were stripped off using a rotary evaporator at 125° C. for two hours.

Example 4

Xylene (40 g) was weighed into the flask to which was added alkylsalicylic acid and lime, and then the flask was filled with the remaining xylene (157 g) and heated to 40° C.

After 135 minutes the temperature was increased to 55° C. and the promoter was added as 16.52 g of a 97:3 Methanol:Water mixture.

After 75 minutes carbonation was started. A total of 0.20 l of carbon dioxide was absorbed by the reaction mixture.

After 15 minutes the carbonation was stopped and the reaction was left to stir at 50° C. under nitrogen for a further 30 minutes.

The flask was removed from the water bath, transferred to a centrifuge can and centrifuged at 2500 rpm for 30 minutes.

The can was removed from the centrifuge, and was found to contain a pale yellow clear liquid with a small amount of solid on the bottom. The liquid was very carefully decanted into a beaker. The solvent was removed by bleeding the liquid into a rotary evaporator containing base oil under full vacuum at 90° C. to leave a brown clear liquid.

Examples 5-7

The reactor was charged with xylene (100 g), followed by alkylsalicylic acid and lime, and then the remaining xylene. Stirring was started at 400 rpm and nitrogen was passed through the mixture at 60 ml/min. The reactor was heated to 40° C.

The promoter had been made previously by mixing 97 g of methanol with 3 g of water. Once the mixture in the reactor had reached approx. 40° C., promoter was introduced to the reactor. The reaction temperature dropped to ~35° C. The mixture was re-heated to 40° C. and held at that temperature for 60 minutes to neutralise.

After 1 hour the heating was turned off, stirring was stopped and the mixture was decanted into four blunt nose 100 ml ASTM centrifuge tubes. The tubes were spun in a centrifuge at 1500 rpm for one hour. While the mixture was spinning the reactor was cleaned thoroughly with acid to remove any unreacted lime.

After centrifuging, the mixture was decanted carefully back into the reactor. Care was taken to not decant any sediment.

Stirring was started at 400 rpm, nitrogen was passed through the mixture at 60 ml/min and the reactor was heated.

When the reactor reached 55° C., carbonation was started at a rate of 50 ml/min for 60 minutes. After this time the carbon dioxide was switched off and the nitrogen was passed through the mixture at 60 ml/min.

The mixture was left to heat soak at 55° C. for 30 minutes.

At the end of heat soak, heating and stirring were stopped and the mixture was decanted into four blunt nose 100 ml ASTM centrifuge tubes. The mixture was spun again in a centrifuge at 1500 rpm for 1 hour.

After centrifugation the tubes were removed from the centrifuge. It was noted that there was a small amount of sediment in the tubes. Also visible was a small layer approx. 0.1% of a clear liquid above the sediment but below the bulk of the liquid. The upper layer (bulk of tube) was clear brown/purple liquid. The upper phase was decanted into a beaker containing the base oil.

The product was then bled into a rotary evaporator under vacuum at 125° C. and the xylene, and any residual methanol and water, were removed.

Focused Beam Reflectance Method ('FBRM)

The overbased metal salicylate detergents were tested for their asphaltene dispersancy using laser light scattering according to the Focused Beam Reflectance method ('FBRM'), which predicts asphaltene agglomeration and hence 'black sludge' formation. The FBRM test method was disclosed at the 7$^{th}$ International Symposium on Marine Engineering, Tokyo, 24-28 Oct. 2005, and was published in 'The Benefits of Salicylate Detergents in TPEO Applications with a Variety of Base Stocks', in the Conference Proceedings. Further details were disclosed at the CIMAC Congress, Vienna, 21-24 May 2007 and published in "Meeting the Challenge of New Base Fluids for the Lubrication of Medium Speed Marine Engines—An Additive Approach" in the Congress Proceedings. In the latter paper it is disclosed that by using the FBRM method it is possible to obtain quantitative results for asphaltene dispersancy that predict performance for lubricant systems based on both Group I and Group II base stocks. The predictions of relative performance obtained from FBRM were confirmed by engine tests in marine diesel engines.

The FBRM probe contains fibre optic cables through which laser light travels to reach the probe tip. At the tip an optic focuses the laser light to a small spot. The optic is rotated so that the focussed beam scans a circular path between the window of the probe and the sample. As particles flow past the window they intersect the scanning path, giving backscattered light from the individual particles.

The scanning laser beam travels much faster than the particles; this means that the particles are effectively stationary.

As the focussed beam reaches one edge of the particle there is an increase in the amount of backscattered light; the amount will decrease when the focussed beam reaches the other edge of the particle.

The instrument measures the time of the increased backscatter. The time period of backscatter from one particle is multiplied by the scan speed and the result is a distance or chord length. A chord length is a straight line between any two points on the edge of a particle. This is represented as a chord length distribution, a graph of numbers of chord lengths (particles) measured as a function of the chord length dimensions in microns. As the measurements are performed in real time the statistics of a distribution can be calculated and tracked. FBRM typically measures tens of thousands of chords per second, resulting in a robust number-by-chord length distribution. The method gives an absolute measure of the particle size distribution of the asphaltene particles.

The Focused beam Reflectance Probe (FBRM), model Lasentec D600L, was supplied by Mettler Toledo, Leicester, UK. The instrument was used in a configuration to give a particle size resolution of 1 μm to 1 mm. Data from FBRM can be presented in several ways. Studies have suggested that the average counts per second can be used as a quantitative determination of asphaltene dispersancy. This value is a function of both the average size and level of agglomerate. In this application, the average count rate (over the entire size range) was monitored using a measurement time of 1 second per sample.

Overbased detergent (10% w/w) and base oil were blended together for fifteen minutes whilst heating to 60° C. and stirring at 400 rpm; when the temperature reached 60° C. the FBRM probe was inserted into the sample and measurements made for 15 minutes. An aliquot of heavy fuel oil (10% w/w) was introduced into the lubricant formulation under stirring using a four blade stirrer (at 400 rpm). A value for the average counts per second was taken when the count rate had reached an equilibrium value (typically after 1 hour).

The overbased metal salicylate detergents were tested in Chevron 600 RLOP Group II basestock.

FBRM Test Results

| Example | DOC, % | Particle Counts, per s |
|---|---|---|
| 1 | 69 | 345 |
| 2 | 71 | 247 |
| 3 | 75 | 215 |
| 4 | 85 | 61 |
| 5 | 100 | 60 |
| 6 | 100 | 67 |
| 7 | 100 | 51 |

As shown in the Table above, the overbased metal salicylate detergents having a degree of carbonation of 80% or greater exhibit lower average counts per second. This value is a function of both the average size and the level of agglomerate. Therefore, the use of an overbased metal salicylate detergent having a degree of carbonation of 80% or greater improves asphaltene dispersancy.

What is claimed is:

1. An overbased metal hydrocarbyl-substituted hydroxybenzoate detergent having a basicity index of less than 2 and a degree of carbonation of 80% or greater, wherein the degree of carbonation is the percentage of carbonate present in the overbased metal hydrocarbyl-substituted hydroxybenzoate detergent expressed as a mole percentage relative to the total excess base in the detergent.

2. The overbased metal hydrocarbyl-substituted hydroxybenzoate detergent as claimed in claim 1, wherein the degree of carbonation is 85% or greater.

3. The overbased metal hydrocarbyl-substituted hydroxybenzoate detergent as claimed in claim 1, wherein the metal is calcium.

4. The overbased metal hydrocarbyl-substituted hydroxybenzoate detergent as claimed in claim 1, wherein the hydrocarbyl-substituted hydroxybenzoate is alkylsalicylate.

5. A lubricating oil composition including an oil of lubricating viscosity and an overbased metal hydrocarbyl-substituted hydroxybenzoate detergent having a basicity index of less than 2 and a degree of carbonation of 80% or greater, wherein the degree of carbonation is the percentage of carbonate present in the overbased metal hydrocarbyl-substituted hydroxybenzoate detergent expressed as a mole percentage relative to the total excess base in the detergent.

6. The lubricating oil composition as claimed in claim 5, wherein the oil of lubricating viscosity is a Group II base stock.

7. The lubricating oil composition as claimed in claim 5, wherein the lubricating oil composition has a TBN of from about 20 to about 60 mg KOH/g.

8. A method of reducing asphaltene precipitation or 'black paint' in an engine, the method including the step of lubricating the engine with a lubricating oil composition including an overbased metal hydrocarbyl-substituted hydroxybenzoate detergent having a basicity index of less than 2 and a degree of carbonation of 80% or greater, wherein the degree of carbonation is the percentage of carbonate present in the overbased metal hydrocarbyl-substituted hydroxybenzoate detergent expressed as a mole percentage relative to the total excess base in the detergent.

9. The overbased metal hydrocarbyl-substituted hydroxybenzoate detergent as claimed in claim 2, wherein the degree of carbonation is at least 90%.

10. The overbased metal hydrocarbyl-substituted hydroxybenzoate detergent as claimed in claim 9, wherein the degree of carbonation is at least 95%.

11. The overbased metal hydrocarbyl-substituted hydroxybenzoate detergent as claimed in claim 10, wherein the degree of carbonation is 100%.

* * * * *